US010448681B2

(12) United States Patent
Mather

(10) Patent No.: US 10,448,681 B2
(45) **Date of Patent: *Oct. 22, 2019**

(54) ARTICLES OF APPAREL INCLUDING ZONES HAVING INCREASED THERMALLY INSULATIVE AND THERMALLY RESISTIVE PROPERTIES

(71) Applicant: NIKE, Inc., Beaverton, OR (US)

(72) Inventor: Sophie Louise Mather, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 676 days.

This patent is subject to a terminal disclaimer.

(21) Appl. No.: 14/491,569

(22) Filed: Sep. 19, 2014

(65) Prior Publication Data

US 2015/0000005 A1 Jan. 1, 2015

Related U.S. Application Data

(63) Continuation of application No. 12/115,884, filed on May 6, 2008, now Pat. No. 8,856,964.

(Continued)

(51) Int. Cl.
*A41D 3/00* (2006.01)
*A41D 1/04* (2006.01)

(Continued)

(52) U.S. Cl.
CPC ..... *A41D 3/00* (2013.01); *A41B 9/06* (2013.01); *A41D 1/04* (2013.01); *A41D 3/005* (2013.01);

(Continued)

(58) Field of Classification Search
CPC ..... A41D 13/00; A41D 1/04; A41D 13/0015; A41D 2400/10; A41D 3/00; A41D 3/02; A41B 9/06

(Continued)

(56) References Cited

U.S. PATENT DOCUMENTS 1,252,187 A 1/1918 Shane
1,329,025 A 1/1920 Smith (Continued)

FOREIGN PATENT DOCUMENTS

CH 614848 A5 12/1979
FR 2890536 A1 3/2007

(Continued)

OTHER PUBLICATIONS

International Search Report in PCT International Application No. PCT/US2008/063029, dated Sep. 22, 2008.

(Continued)

*Primary Examiner* — Alissa L Hoey
(74) *Attorney, Agent, or Firm* — Banner & Witcoff, Ltd.

(57) ABSTRACT

Thermal garments with reduced weight and bulk and improved packability include targeted zones of increased thermal resistive properties. Such garments may include: (a) a first garment region extending along a central back portion of the garment from the waist area of the garment to the neck area; (b) second and third garment regions extending along the sides of the garment from the waist area to the underarm area; and (c) a fourth garment region extending between the first and second garment regions, between the first and third garment regions, and between the second and third garment regions. The fourth garment region includes a thermal material having a lower thermal resistive value than the thermal resistive values of the thermal materials associated with the first, second, and third garment regions. Methods of making such garments also are described.

4 Claims, 4 Drawing Sheets

Related U.S. Application Data

(60) Provisional application No. 60/916,599, filed on May 8, 2007.

(51) Int. Cl.
*A41D 13/00* (2006.01)
*A41B 9/06* (2006.01)

(52) U.S. Cl.
CPC ..... *A41D 13/00* (2013.01); *A41D 13/0015* (2013.01); *A41D 2400/10* (2013.01)

(58) Field of Classification Search
USPC ..... 2/85, DIG. 1
See application file for complete search history.

(56) References Cited

U.S. PATENT DOCUMENTS

| | | | | |
|---|---|---|---|---|
| 2,079,990 | A | 5/1937 | Anders | |
| 2,391,535 | A | 12/1945 | Zelano | |
| 2,627,072 | A | 2/1953 | Frommelt | |
| 3,034,133 | A | 5/1962 | Eilenberg | |
| 3,078,699 | A | 2/1963 | Huntley | |
| 3,296,626 | A | 1/1967 | Ludwikowski | |
| 3,744,052 | A | 7/1973 | Rector | |
| 4,513,451 | A | 4/1985 | Brown | |
| 4,569,874 | A | 2/1986 | Kuznetz | |
| 4,583,247 | A | 4/1986 | Fingerhut et al. | |
| 4,608,715 | A | 9/1986 | Miller et al. | |
| 4,658,442 | A | 4/1987 | Tomlinson et al. | |
| 4,685,155 | A | 8/1987 | Fingerhut et al. | |
| 4,696,066 | A | 9/1987 | Ball et al. | |
| 4,722,099 | A | 2/1988 | Kratz | |
| 4,783,858 | A | 11/1988 | Chevalier | |
| 4,796,304 | A | 1/1989 | Shelby | |
| 4,800,593 | A | 1/1989 | Ruffner | |
| 4,807,303 | A | 2/1989 | Mann et al. | |
| 4,946,453 | A | 8/1990 | Monson | |
| 4,999,845 | A | 3/1991 | Jenks, Jr. et al. | |
| 5,105,478 | A | 4/1992 | Pyc | |
| 5,210,877 | A | 5/1993 | Newman | |
| 5,282,277 | A | 2/1994 | Onozawa | |
| 5,469,581 | A | 11/1995 | Uthoff | |
| 5,526,532 | A | 6/1996 | Willard | |
| 5,727,256 | A | 3/1998 | Rudman | |
| 5,742,936 | A | 4/1998 | Tronc | |
| 5,792,714 | A | 8/1998 | Schindler et al. | |
| 5,915,531 | A | 6/1999 | Hilbert et al. | |
| 6,018,819 | A | 2/2000 | King et al. | |
| 6,109,338 | A | 8/2000 | Butzer | |
| 6,279,161 | B1 | 8/2001 | Johnston | |
| 6,332,221 | B1 | 12/2001 | Gracey | |
| 6,339,845 | B1 | 1/2002 | Burns et al. | |
| 6,904,612 | B2 | 6/2005 | Spongberg | |
| 6,996,848 | B2 | 2/2006 | Donaldson | |
| 7,043,766 | B1 | 5/2006 | Foreman et al. | |
| 7,543,338 | B2 | 6/2009 | Culhane | |
| 7,560,399 | B2 | 7/2009 | Rock et al. | |
| 7,581,258 | B2 | 9/2009 | Baron et al. | |
| 7,636,950 | B2 | 12/2009 | Melhart et al. | |
| 7,743,476 | B2 | 6/2010 | Rock et al. | |
| D635,334 | S * | 4/2011 | Eckman | D2/847 |
| 7,971,271 | B2 | 7/2011 | Raghuprasad | |
| 8,898,816 | B2 * | 12/2014 | Highfield | A41D 1/002 2/247 |
| 2003/0041364 | A1 | 3/2003 | Donaldson | |
| 2003/0061650 | A1 | 4/2003 | Emanuel | |
| 2003/0079271 | A1 | 5/2003 | Gillen et al. | |
| 2005/0015843 | A1 | 1/2005 | Roux et al. | |
| 2005/0034204 | A1 | 2/2005 | Kassai et al. | |
| 2005/0204448 | A1 | 9/2005 | Wise et al. | |
| 2005/0204449 | A1 | 9/2005 | Baron et al. | |
| 2005/0246813 | A1 | 11/2005 | Davis et al. | |
| 2005/0278820 | A1 | 12/2005 | Newman | |
| 2006/0048263 | A1 | 3/2006 | Walsh | |
| 2006/0107436 | A1 | 5/2006 | Donaldson | |
| 2006/0179539 | A1 | 8/2006 | Harber | |
| 2006/0277645 | A1 | 12/2006 | Okajima | |
| 2006/0277950 | A1 | 12/2006 | Rock | |
| 2007/0022510 | A1 | 2/2007 | Chapuis et al. | |
| 2007/0033696 | A1 | 2/2007 | Sellier | |
| 2007/0050879 | A1 | 3/2007 | Etzold et al. | |
| 2007/0050881 | A1 | 3/2007 | Kasprzak | |
| 2008/0028494 | A1 | 2/2008 | Newman | |
| 2008/0098503 | A1 | 5/2008 | Swartz | |
| 2008/0216206 | A1 | 9/2008 | Mazzarolo | |
| 2013/0291278 | A1 * | 11/2013 | Volpis | A41D 13/00 2/69 |
| 2014/0317825 | A1 * | 10/2014 | Silverberg | A41D 13/1209 2/69 |

FOREIGN PATENT DOCUMENTS

| | | | |
|---|---|---|---|
| GB | 2193429 | A | 2/1988 |
| GB | 2344738 | A | 6/2000 |
| GB | 2410673 | A | 8/2005 |
| JP | 54-149407 | U | 10/1979 |
| JP | 2001-192901 | A | 7/2001 |
| JP | 2006161232 | A | 6/2002 |
| JP | 2002327301 | A | 11/2002 |
| WO | 02/089616 | A1 | 11/2002 |
| WO | 2007/149268 | A2 | 12/2007 |

OTHER PUBLICATIONS

International Preliminary Report on Patentability in PCT International Application No. PCT/US2008/063029, dated Nov. 19, 2009.
First Office Action issued in Chinese Application No. 200880019250.2, dated Nov. 9, 2010.
Office Action issued in European Patent Application No. 08 755 161.0 dated May 14, 2012.
Rejection issued in Japanese Patent Application No. 2010-507649 dated Dec. 26, 2011.
Notice of Reasons for Rejection issued in Japanese Patent Application No. 2010-507649 dated Jun. 13, 2012.
Notice of Reasons for Rejection issued in Japanese Patent Application No. 2010-507649 dated Jan. 28, 2013.
First Office Action issued in Chinese Patent Application No. 201210005800.3 dated Nov. 15, 2013.
Japanese Office Action dated Sep. 29, 2014 in Japanese Application No. 2010-507649.
"Dictionary Definition of Outerware", Random House Webster's Unabridged Dictionary, Second Edition, Copyright 2001.
"Test Methods Measuring Breathability" www.nemoequipment.com/pdfs/classroom/testingbreathability_v2.pdf. , available on Internet at least by May 1, 2014 (original publication date not known).
"KES-F7 Thermo Labo IIB system" ("Precise and Fast Thermal Property Measuring Instrument") Kato Tech Co., Ltd. http://www.keskato.co.jp/, available on Internet at least by May 1, 2014 (original publication date not known).

* cited by examiner

ARTICLES OF APPAREL INCLUDING ZONES HAVING INCREASED THERMALLY INSULATIVE AND THERMALLY RESISTIVE PROPERTIES

RELATED APPLICATION DATA

This application claims priority benefits based on: (a) pending U.S. patent application Ser. No. 12/115,884 entitled "Articles of Apparel Including Zones Having Increased Thermally Insulative and Thermally Resistive Properties," filed May 6, 2008 and (b) U.S. Provisional Patent Application No. 60/916,599 entitled "Articles of Apparel Including Zones Having Increased Thermally Insulative and Thermally Resistive Properties," filed May 8, 2007. Each of these priority applications is entirely incorporated herein by reference.

FIELD OF THE INVENTION

Aspects of the present invention generally relate to cold weather garments that include one or more zones with increased thermally insulative and/or thermally resistive properties. Such garments can allow wearers to maintain a necessary or desired degree of warmth with decreased garment weight and bulk. Such garments also can have improved packability for storage, shipping, and/or travel.

BACKGROUND

The human body may suffer adverse effects when exposed to cool or cold environmental conditions, particularly when exposed to such conditions for lengthy time periods. While people can simply add another layer of clothing to help stave off the adverse effects of a cold environment in some situations, this simple solution does not necessarily work well for athletes involved in practice or competition. For example, the addition of clothing layers can adversely impact the wearer's ability to freely move, particularly when engaged in exercise, athletic events, or other activities requiring movement. The additional weight, bulk, and/or wind resistance resulting from the additional clothing also can adversely impact athletic performance and expose the athlete to injury due to diminished flexibility, performance, and the like. The adverse impacts on performance and comfort may deter some users from adequately dressing to protect themselves from the cold. This attempted "work-around" action also can harm the wearer's health and well being.

Therefore, improvements in garment structures, particularly for athletic use in cold environments, would be a welcome advance in the art.

SUMMARY

Some example aspects of the present invention relate to garment structures that have excellent thermal insulative and thermal resistive properties while reducing garment weight and/or bulk and/or improving the garment's packability or loft. These and other advantageous properties may be realized, in accordance with examples of this invention, by providing a garment structure including targeted zones of increased thermal insulative or thermal resistive properties. More specifically, garments in accordance with examples of this invention may include: (a) a first garment region extending along a central back portion of the garment from proximate to a waist area of the garment to proximate to a neck area of the garment; (b) a second garment region extending along a first side of the garment from proximate to the waist area to proximate to a first underarm area of the garment; (c) a third garment region extending along a second side of the garment from proximate to the waist area to proximate to a second underarm area of the garment; and (d) a fourth garment region extending between the first and second garment regions, between the first and third garment regions, and between the second and third garment regions. At least a majority of the fourth garment region in accordance with at least some examples of this invention (which may include multiple parts or pieces of material) will include a first thermal material having a first thermal resistive value, and the first, second, and third garment regions will include thermal materials (which may be the same as or different from one another) having higher thermal resistive values than the first thermal value. The first, second, and third garment regions may have thermal resistive values of at least 5% higher than that of the first thermal resistive value (for the fourth garment region), and in some examples, the first through third garment regions will have thermal resistive values of 10% higher, at least 15% higher, at least 20% higher, at least 25% higher, or even at least 50% higher.

Additional aspects of this invention relate to methods of forming garments, e.g., of the various types described above. Such methods may include formation of garments as a single piece (e.g., by knitting or other garment forming processes) to include the various regions or formation of garments from multiple pieces joined together, e.g., in conventional ways, such as by sewing or stitching techniques, by adhesives or other fusing techniques, etc. The first, second, and third garment regions may be made from separate and independent pieces of fabric material (optionally the same type of fabric material) that are joined to a separate piece of fabric material embodying the fourth garment region (e.g., by sewing or other techniques). Alternatively, if desired, one or more of the various garment regions may be included as part of a single piece of material.

BRIEF DESCRIPTION OF THE DRAWINGS

Various aspects, objects, features, and advantages of the present invention will be more readily apparent and more fully understood from the following detailed description, taken in conjunction with the appended drawings, in which.

Figure 1A:
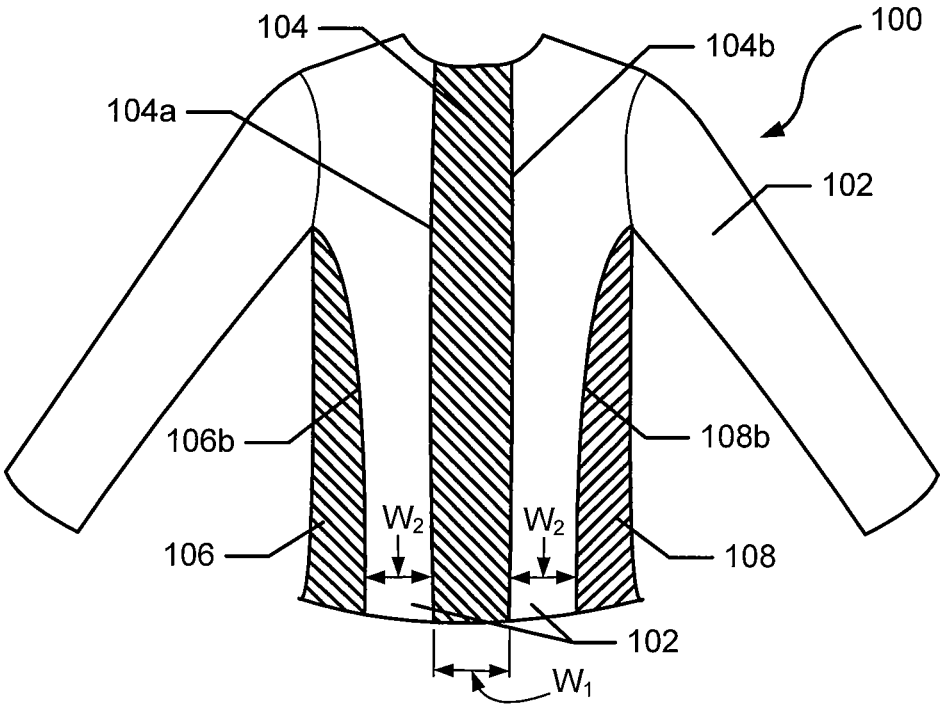
FIGS. 1A and 1B illustrate a garment structure in accordance with an example of this invention.

The reader is advised that the attached drawings schematically illustrate various structures and features of garments in accordance with examples of this invention. These drawings are not production drawings, and they are not necessarily drawn to scale.

DETAILED DESCRIPTION

Various specific examples of the invention are described in detail below in conjunction with the attached drawings. The following provides a general description of aspects and features of structures according to examples of the invention as a prelude to the more detailed description of specific structures that follows.

The term "thermal resistance" or "thermal resistivity," as used herein (also referred to as "Rct") relates to the ability of a material to resist the transfer of heat by conduction, radiation, and convection. In terms of fabric materials or garments, these terms may be considered as relating to the amount of energy required to keep the air temperature constant between skin and fabric while the outside or environmental air temperature is cooler. Because heat always flows from warm to cold, one way to control conduction of heat to the outside of a garment is by using an insulating material in the garment, and the insulating material's "thermal resistance" or "thermal resistivity" is a measure of the material's ability to withstand this transfer of heat.

For fabrics, thermal resistance may be measured by an International Organization for Standardization Test ISO 11092 (entitled "Measurement of Thermal and Water-Vapour Resistance Under Steady-State Conditions" (e.g., measurable by the commercially available "Sweating Guarded Hotplate" system, available, for example, from Measurement Technology Northwest of Seattle, Wash.). This test method, which is publicly known, is incorporated herein by reference. In general, in this test method, a hotplate with in integral "sweating" surface in placed in a climatic chamber having a variable speed airflow hood, a gravity fed fluid supply system, and ambient temperature and humidity probes (to thereby duplicate or simulate human skin in real world conditions of temperature, relative humidity, and wind speed). Heat transfer across material samples can be measured using this system (e.g., the various parameters, such as temperature, humidity, and wind speed may be controlled (changed in a controlled manner or held constant) to enable relative comparison of fabrics. The test results by this system are expressed in units of "square meters×° Kelvin/Watts" ($m^2 \times K/W$).

I. GENERAL DESCRIPTION OF ASPECTS OF THE INVENTION

A. Garments in Accordance with Example Aspects of this Invention

In general, at least some example aspects of this invention relate to garments (also called "articles of apparel" herein) that may include: (a) a first garment region extending along a central back portion of the garment from proximate to a waist area of the garment to proximate to a neck area of the garment; (b) a second garment region extending along a first side of the garment from proximate to the waist area to proximate to a first underarm area of the garment; (c) a third garment region extending along a second side of the garment from proximate to the waist area to proximate to a second underarm area of the garment; and (d) a fourth garment region extending between the first and second garment regions, between the first and third garment regions, and between the second and third garment regions. The fourth garment region in accordance with at least some examples of this invention will include a first thermal material having a first thermal resistive value, and the first, second, and third garment regions will include thermal materials (which may be the same as or different from one another) having higher thermal resistive values than the first thermal resistive value. In some more specific example garment structures, the first, second, and third garment regions may have thermal resistive values of at least 5% higher than that of the first thermal resistive value (for the fourth garment region), and in some examples, these thermal resistive values will be at 10% higher, at least 15% higher, at least 20% higher, at least 25% higher, or even at least 50% higher.

Garment structures in accordance with examples of this invention may take on a variety of forms or structures without departing from this invention. For example, the garment may be structured such that the fourth garment region extends between the first and second garment regions, between the first and third garment regions, and between the second and third garment regions at the waist area of the garment to thereby completely separate the first, second, and third garment regions from one another along the waist area. The fourth garment region may make up at least 50% (or even at least 70%) of an overall interior surface, an overall exterior surface, and/or an overall volume of the garment structure.

The garment region extending along the central spinal portion of the wearer's back (the "first garment region" mentioned above) may include portions (and optionally a major portion) that are at least 2 inches wide (e.g., for child sizes), at least 3 inches wide (e.g., for women's sizes), at least 4 inches wide (e.g., for men's sizes), or even wider. Similarly, at least some portions (and optionally, a majority) of the second and third garment regions (along the wearer's sides) may be at least 2 inches wide (e.g., for child sizes), at least 3 inches wide (e.g., for women's sizes), at least 4 inches wide (e.g., for men's sizes), or even wider. In some garment structures, one or more of the various garment regions may be even larger. For example, in some garment structures in accordance with this invention, the first garment region may include a majority of a back portion of the garment, and even at least 75% of a back portion of the garment (optionally, in at least some example structures, the garment region that covers the central spine portion also will cover all or most of a scapular area of the garment).

For some garment structures in accordance with examples of this invention, such as for outerwear structures (e.g., jackets, vests, coats, and other exterior garments), the fourth garment region (i.e., the relatively low thermal resistive region) may have a thermal resistive value of at least 0.12 $m^2 \times K/W$, at least 0.15 $m^2 \times K/W$, at least 0.19 $m^2 \times K/W$, or even at least 0.23 $m^2 \times K/W$, and thermal resistive values for the first, second, and third garment regions in such garment structures will be at least 5% (or even 10%) higher than the thermal resistive value for the fourth region (and in some more specific structures, may be at least 0.15 $m^2 \times K/W$, at least 0.18 $m^2 \times K/W$, at least 0.21 $m^2 \times K/W$, or even at least 0.25 $m^2 \times K/W$). For other garment structures in accordance with examples of this invention, such as for undergarments, mid-layer garments, or other thin garment structures (such as athletic wear), the fourth garment region may have a thermal resistive value of at least 0.03 $m^2 \times K/W$, at least 0.05 $m^2 \times K/W$, at least 0.07 $m^2 \times K/W$, or even at least 0.10 $m^2 \times K/W$, and the thermal resistive values for the first, second, and third garment regions in such structures will be at least 5% (or even 10%) higher than the thermal resistive value for the fourth region (and in some more specific structures, may be at least 0.04 $m^2 \times K/W$, at least 0.06 $m^2 \times K/W$, at least 0.08 $m^2 \times K/W$, or even at least 0.12 $m^2 \times K/W$).

Garments may include additional features without departing from this invention. For example, garments in accordance with at least some examples of this invention may include closure systems and/or opening size adjusting systems. Examples of such systems include zippers, buttons, snaps, straps, buckles, hook-type fasteners, hook-and-loop type fasteners, draw string adjusting mechanisms, elastic materials, etc.

A wide variety of overall garment structures may be provided without departing from this invention. Garment structures in accordance with at least some examples of this invention may cover at least a portion of an upper torso of a human body and may take on a variety of forms, such as shirts, T-shirts, jackets, vests, sweaters, turtlenecks, mock turtlenecks, garment liners, coats, etc. Additionally, garment structures in accordance with at least some examples of this invention may include garments that, in addition to covering at least a portion of a human upper torso, cover at least a portion of the pelvis and/or lower torso, such as leotards, athletic suits (e.g., of the types used by athletes in winter sports, such as unitards worn in speed skating, skiing, bobsledding, luging, and the like), coveralls, snowsuits, and the like.

B. Methods of Making Garments in Accordance with Example Aspects of this Invention Additional aspects of this invention relate to methods of forming garments, e.g., of the various types described above. Such methods may include, for example: forming a garment structure including: (a) a first garment region extending along a central back portion of the garment from proximate to a waist area of the garment to proximate to a neck area of the garment, (b) a second garment region extending along a first side of the garment from proximate to the waist area to proximate to a first underarm area of the garment, (c) a third garment region extending along a second side of the garment from proximate to the waist area to proximate to a second underarm area of the garment, and (d) a fourth garment region extending between the first and second garment regions, between the first and third garment regions, and between the second and third garment regions. The fourth garment region in accordance with at least some examples of this invention will be formed to include a first thermal material having a first thermal resistive value, wherein the first, second, and third garment regions include thermal materials (which may be the same as or different from one another) having higher thermal resistive values than the first thermal resistive value. Such garment structures may take on any of the various forms and/or have any of the various characteristics or combinations of characteristics as described above.

Methods according to at least some examples of this invention may include formation of garments as a single piece (e.g., by knitting or other garment forming processes). Alternatively, if desired, garment structures in accordance with at least some examples of this invention may be made from multiple fabric pieces joined together, e.g., in conventional ways as are known and used in the art (such as by sewing or stitching techniques, by adhesives or other fusing techniques, etc.). If desired, the first, second, and third garment regions may be made from separate and independent pieces of fabric material (optionally the same type of fabric material) that are joined to one or more separate pieces of fabric material embodying the fourth garment region (e.g., by sewing or other techniques). Alternatively, if desired, two or more of the various regions may be included as part of a single piece of material.

Specific examples of the invention are described in more detail below. The reader should understand that these specific examples are set forth merely to illustrate examples of the invention, and they should not be construed as limiting the invention.

II. SPECIFIC EXAMPLES OF THE INVENTION

The figures in this application illustrate various examples of garment structures in accordance with this invention. When the same reference number appears in more than one drawing, that reference number is used consistently in this specification and the drawings to refer to the same or similar parts or elements throughout.

Figure 1B:
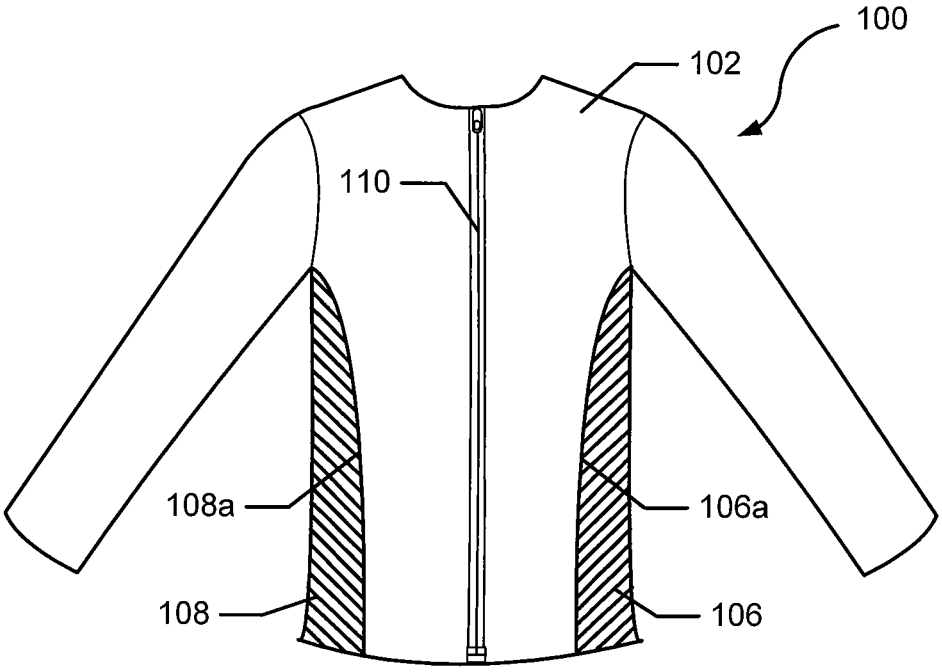

FIGS. 1A and 1B illustrate the back and front, respectively, of a garment structure 100 in accordance with one example of this invention. As shown, this garment structure 100 has one garment region 102 that makes up a majority of the overall garment structure 100 (e.g., the majority of the garment's interior surface, exterior surface, and/or volume). In this illustrated example, garment region 102 forms most of the garment front (see FIG. 1B), all of the sleeves, and a substantial portion (a majority) of the garment back (see FIG. 1A). Garment region 102 may be made from one or multiple pieces without departing from the invention.

The garment structure 100 includes other discrete regions as well. At least some of these additional regions will be regions having increased thermal insulative properties or increased thermal resistance as compared to region 102. As shown in FIG. 1A, one of these regions, region 104, extends along the central back portion of the garment structure 100. Another of these regions, region 106 in this example garment structure 100, extends along one side portion of the garment structure 100 and another region 108 extends along the other side portion of the garment structure 100. Each of regions 104, 106, and 108 in this example structure 100 has an increased thermal insulative property and an increased thermal resistance as compared to region 102. Region 102 lies between and separates at least some portions of regions 104, 106, and 108 from one another. If desired, any or all of regions 104, 106, and/or 108 may be made from multiple pieces of fabric without departing from this invention.

Thermal research on the human body has demonstrated that the body releases a substantial amount of its heat at a person's central back area (along the spine) and at the person's sides. Therefore, providing adequate thermal insulation in these areas of a garment can help keep the garment wearer warm by holding this released heat close to the body. Providing a garment structure with discrete zones of increased thermal insulative or thermal resistant material at one or more of these targeted zones or locations of the body (with less thermally insulative or resistive material at other locations) allows one to produce a relatively lightweight and less bulky cold weather garment that still performs well in keeping the wearer warm. Such lightweight and reduced bulk garments can be particularly useful for athletes and others where free movement and flexibility are important. The lightweight and low bulk garments also are advantageous for relatively compact packing purposes (e.g., reduced product volume from a manufacturer's or wholesaler's perspective (e.g., for product shipping and storage), from a retailer's perspective (e.g., for display or storage), and/or from an end user's perspective (when packing for a trip, storing at home, etc.).

Differences in thermal insulative properties or thermal resistance may be achieved in the various different regions 102, 104, 106, and 108 of a garment structure 100 in a variety of different manners without departing from this invention. For example, if desired, the various regions of the garment structure 100 may be made from separate and distinct pieces of fabric material that have different thermal insulative or thermal resistance properties, and these various pieces of material may be sewn together or otherwise engaged together (e.g., in manners that are known and conventionally used in the garment production arts) so as to provide the higher thermal insulative or thermal resistive materials at the desired locations (regions 104, 106, and/or 108) in the garment structure 100. As another example, if desired, the regions 104, 106, and/or 108 of the garment structure 100 having higher thermal insulative or thermal resistance properties may be provided by using different (higher insulative) fill materials, by providing a fill material (as compared to an absence of fill material in region 102), and/or by providing more fill material in regions 104, 106, and 108 as compared with region(s) 102. Any desired thermally insulative or thermally resistive fill materials may be used without departing from this invention, such as down materials, insulative textile or fabric fill materials, etc. As yet additional examples, if desired, regions 104, 106, and/or 108 may be coated, laminated, impregnated, doped, and/or otherwise treated as compared to region 102 (and/or region 102 treated as compared to regions 104, 106, and/or 108) to thereby alter their thermal insulative and/or thermal resistive properties.

Any desired fabric materials may be used for garments structures in accordance with examples of this invention. As some more specific examples, the garments (including all of the noted regions 102-108) may be made from one or more "thermal materials," e.g., materials that help retain body heat or that are resistive to heat transfer. The thermal materials may be natural or synthetic fabrics (e.g., cottons, polyesters, or other polymeric materials, etc.). As some even more specific examples, the thermal materials for any and/or all regions 102-108 of the overall garment structure 108 may be polyester fleece or other polyester thermal materials, such as the THERMA-FIT® and SPHERE® Thermal fabric materials commercially available in various garment products from NIKE, Inc. of Beaverton, Oreg.

Any desired degree of difference in thermal insulative or thermal resistive properties may be provided in the various regions without departing from this invention (e.g., in region(s) 102 as compared to regions 104, 106, and/or 108). For example, if desired, in accordance with at least some examples of this invention, region 102 may have at least 5% lower thermal insulative or thermal resistive properties as compared to regions 104, 106, and/or 108. In still other examples, this difference may be at least 10% lower, at least 15% lower, at least 20% lower, at least 25% lower, or even at least 50% lower without departing from the invention.

The thermal insulative and thermal resistive characteristics designed into or provided as part of a garment structure 100 may depend, at least in part, on its intended use, the expected environmental conditions (e.g., temperature range, wind speed, humidity, etc.), etc. For garments targeted for use as an outerwear product (e.g., coats, jackets, vests, sweaters, etc.), the minimum thermal resistive value for the high thermally resistive regions 104, 106, and/or 108 may be at least 0.15 $m^2 \times K/W$, and in some examples, at least 0.18 $m^2 \times K/W$, at least 0.21 $m^2 \times K/W$, or even at least 0.25 $m^2 \times K/W$. The thermal resistive value for the lower thermally resistive region(s) 102 in such structures may be at least 0.13 $m^2 \times K/W$, at least 0.16 $m^2 \times K/W$, at least 0.19 $m^2 \times K/W$, or even at least 0.23 $m^2 \times K/W$, e.g., depending at least in part on the thermal resistive value of the higher thermally resistive regions 104, 106, and/or 108. For garments targeted for use as a mid-layer product (e.g., beneath a coat, jacket, or vest; as an undergarment, sweater, turtleneck, mock turtleneck, etc.; etc.) or as a thin performance garment (e.g., relatively tight, form-fitting garments and other garments as worn by athletes competing in cold weather events and competitions), the minimum thermal resistive value for the high thermally resistive regions 104, 106, and/or 108 may be at least 0.04 $m^2 \times K/W$, and in some examples, at least 0.06 $m^2 \times K/W$, at least 0.08 $m^2 \times K/W$, or even at least 0.12 $m^2 \times K/W$ (the thermal resistive value for the lower thermally resistive region(s) 102 in such structures may be at least 0.03 $m^2 \times K/W$, at least 0.05 $m^2 \times K/W$, at least 0.07 $m^2 \times K/W$, or even at least 0.1 $m^2 \times K/W$, e.g., depending at least in part on the thermal resistive value of the higher thermally resistive regions 104, 106, and/or 108).

As another example, the differences in thermal insulative or thermal resistive characteristics for the various regions 102-108 may be accomplished through the use of materials in the garment structure 100 having different filling weights. In at least some examples of this invention, the lower thermally insulative or thermally resistive region(s) 102 may have a filling weight of at least 60 grams, and in some examples at least 80 grams, at least 100 grams, at least 120 grams, or even at least 150 grams. In such structures, the higher thermally insulative or thermally resistive regions 104, 106, and/or 108 may have filling weights of at least 80 grams, and in some examples, at least 100 grams, at least 120 grams, at least 150 grams, or even at least 180 grams.

The various regions 102, 104, 106, and/or 108 in the garment structure 100 also may take on a wide variety of different sizes and/or shapes without departing from this invention. In the illustrated example, region 104 extends continuously from proximate to the neck area of the garment structure 100 to proximate to the waist area. This region 104 is defined by two substantially parallel sides 104*a* and 104*b* that extend along the spinal area of the garment structure 100. The width of the region 104 may be selected, at least in part, based on the overall garment size. For example, for children's sizes, at least a majority of the region 104 may be at least 2 inches wide (dimension "$W_1$"); for women's sizes, at least a majority of the region 104 may be at least 3 inches wide; and for men's sizes, at least a majority of the region 104 may be at least 4 inches wide.

The side regions 106 and 108 in this example structure 100 wrap around the garment 100 in a direction from the front to back and extend continuously between proximate to the underarm area of the garment structure 100 to proximate to the waist area. As illustrated, these regions 106 and 108 are separated from region 104 and from each other by the lower thermally resistive region 102. In at least some example garment structures 100 according to this invention, the minimum width (dimension "$W_2$") of the region 102 between region 104 and regions 106 and 108 will be at least 50% of the width $W_1$, and in some examples, at least 75% of the width $W_1$, or even at least 100% of the width $W_1$.

The side regions 106 and 108 in this example structure 100 are defined by two side edges (106*a* and 106*b* and 108*a* and 108*b*, respectively) that are separated from one another at the waist area but converge together and meet beneath the arm. The width of the side regions 106 and 108 at the waist area (between edges 106*a* and 106*b* and edges 108*a* and 108*b*) may be selected, at least in part, depending on the overall garment size. For example, for children's sizes, the width of the side regions 106 and 108 at the waist area (and optionally along at least a majority of their length) may be at least 2 inches wide; for women's sizes, the width of the side regions 106 and 108 at the waist area (and optionally along at least a majority of their length) may be at least 3 inches wide; and for men's sizes, the width of the side regions 106 and 108 at the waist area (and optionally along at least a majority of their length) may be at least 4 inches wide.

FIG. 1B further illustrates that garment structures 100 in accordance with examples of this invention further may include a closure system 110. Any type of closure system may be included, at any desired location(s) in the garment structure 100 (e.g., as part of any one or more of the regions 102-108), without departing from this invention. In this illustrated example garment structure 100, the closure system 110 is a conventional zipper type closure system. Other potential closure systems that may be included in garment structures without departing from this invention include, for example: buttons, snaps, hook-type fasteners, hook-and-loop type fasteners, draw string and/or tie type fasteners, straps, buckles, etc.

Figure 2A:
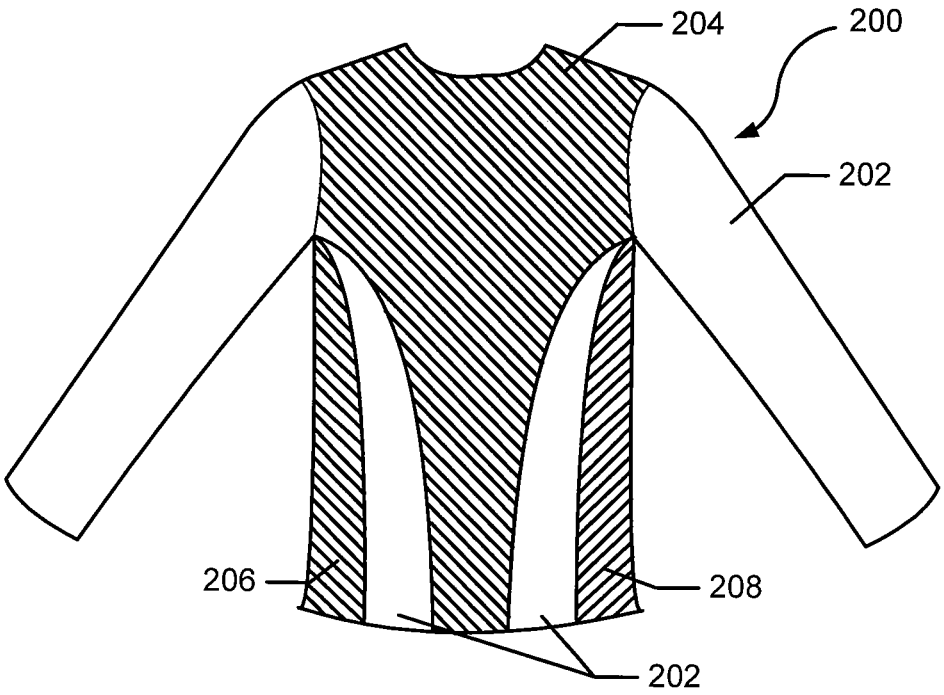
FIGS. 2A and 2B illustrate another garment structure in accordance with an example of this invention.
Figure 2B:
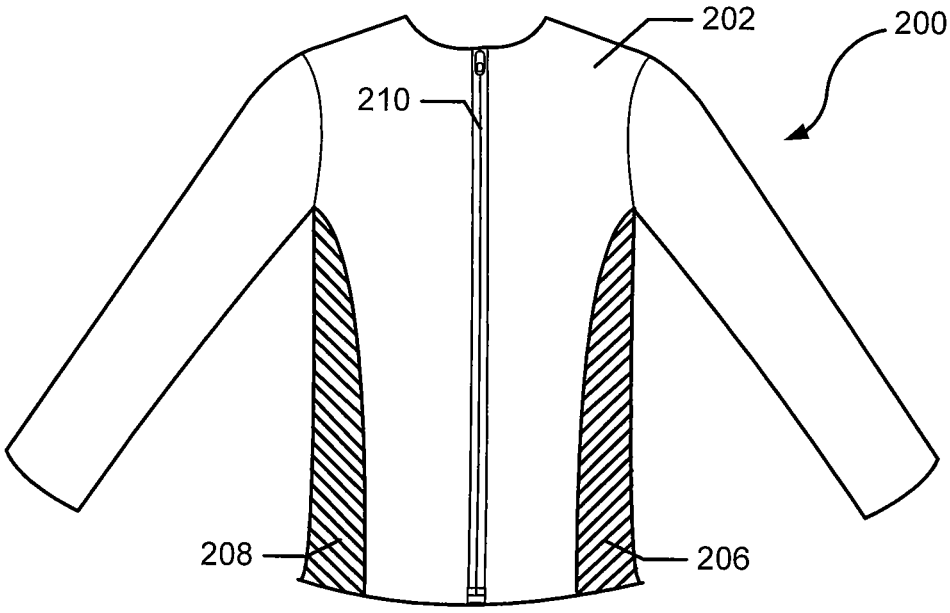

As mentioned above, the various regions of a garment structure may have a variety of shapes, sizes, and/or arrangements without departing from this invention. FIGS. 2A and 2B illustrate another example garment structure 200 in accordance with this invention. Like the structure 100 shown in FIGS. 1A and 1B, this example garment structure 200 includes four regions, namely relatively low thermally insulative and/or resistive region 202 and relatively high thermally insulative or resistive regions 204, 206, and 208 extending along the central spine and side areas of the garment structure 200. These various regions may have any of the various types of constructions, arrangements, materials, and the like as described above in conjunction with FIGS. 1A and 1B. A similar zipper type closure system 210 also is provided in the structure 200 of FIGS. 2A and 2B, although other types of closure systems may be used without departing from this invention.

The structure 200 of FIGS. 2A and 2B differs from that illustrated in FIGS. 1A and 1B in the central back covering high thermally insulative/thermally resistive region 204 (as compared to region 104). As shown, region 204 covers the majority of the back portion of the garment structure 200, and in fact, in this illustrated example structure 200, region 204 covers more than 70% (and even more than 80%) of the rear surface area and/or rear volume of the garment structure 200. If desired, as illustrated in FIG. 2A, region 204 can meet or extend close to the side regions 206 and/or 208, particularly at the underarm area of the garment structure 200, in this particular example. Thus, the high thermally resistive regions (204, 206, and 208) need not be maintained totally separate from one another, e.g., they may lie adjacent or may be continuous with respect to one another over at least some portion of the garment structure 200 (such as at the underarm region, along the waist area, etc.). This overall garment structure 200 can help better hold in heat as compared to the structure 100 illustrated in FIGS. 1A and 1B (e.g., for use in colder weather conditions). The side regions 206 and/or 208 in this illustrated example structure 200 have the same general size, shape, materials, arrangement, and/or separations at the waist area from region 204 and from each other as those features described above in conjunction with FIGS. 1A and 1B.

Figure 3A:
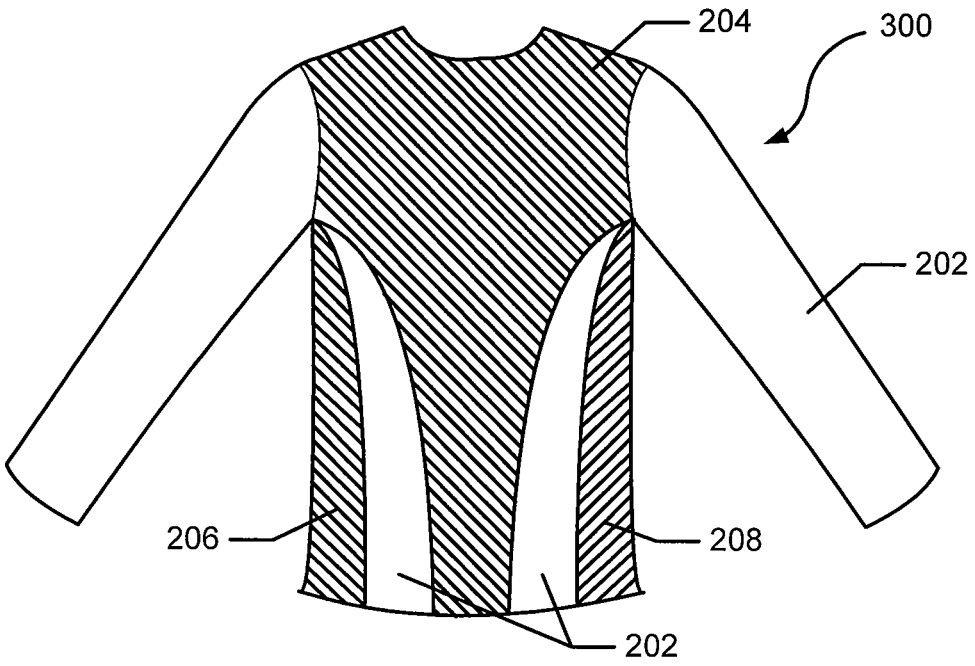
FIGS. 3A and 3B illustrate another garment structure in accordance with an example of this invention.
Figure 3B:
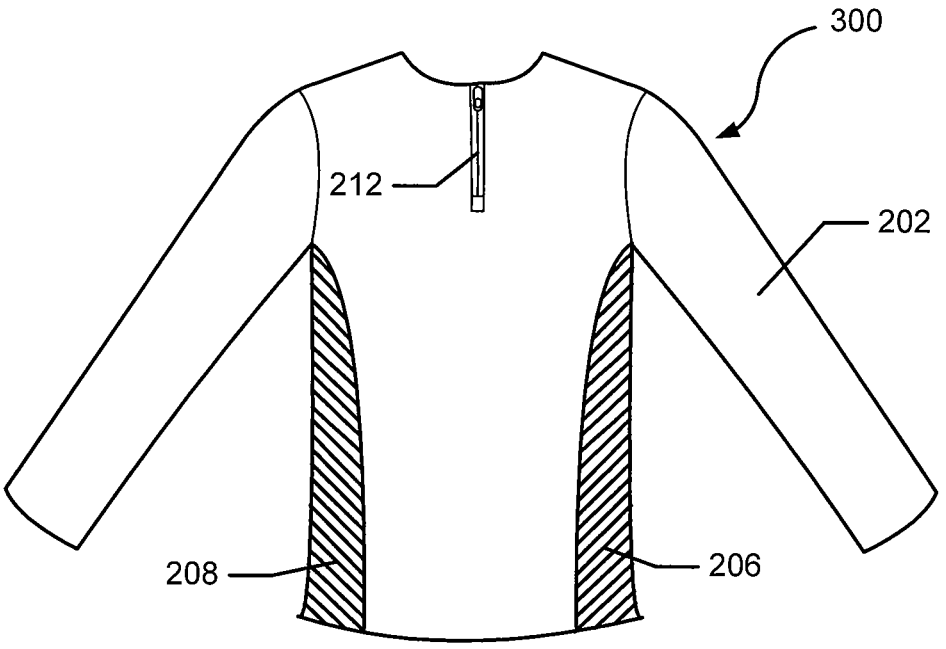

Another example garment structure 300 according to aspects of this invention is illustrated in FIGS. 3A and 3B. As shown, this example garment structure 300 is similar to that shown in FIGS. 2A and 2B, but the fully opening and closing garment closure system 210 of FIGS. 2A and 2B is eliminated in favor of a garment closure system in the form of an opening size adjusting mechanism 212. While a zipper type size adjusting mechanism 212 is illustrated in FIG. 3B, other types of closure/size adjusting systems may be used without departing from this invention, including, for example: buttons, snaps, hook-type fasteners, hook-and-loop type fasteners, draw string and/or tie type fasteners, elastic materials, straps, buckles, etc. Additionally or alternatively, opening size adjusting mechanisms of the same or different types may be provided at other locations and/or at other openings in the garment structure 300 (as well as in the other garment structures 100 and 200 illustrated above in conjunction with FIGS. 1A through 2B), such as at the waist opening and/or at the arm/wrist openings. The various regions 202, 204, 206, and/or 208 of this example garment structure 300 may have any of the various types of constructions, arrangements, materials, and the like as described above in conjunction with FIGS. 1A through 2B.

Figure 4A:
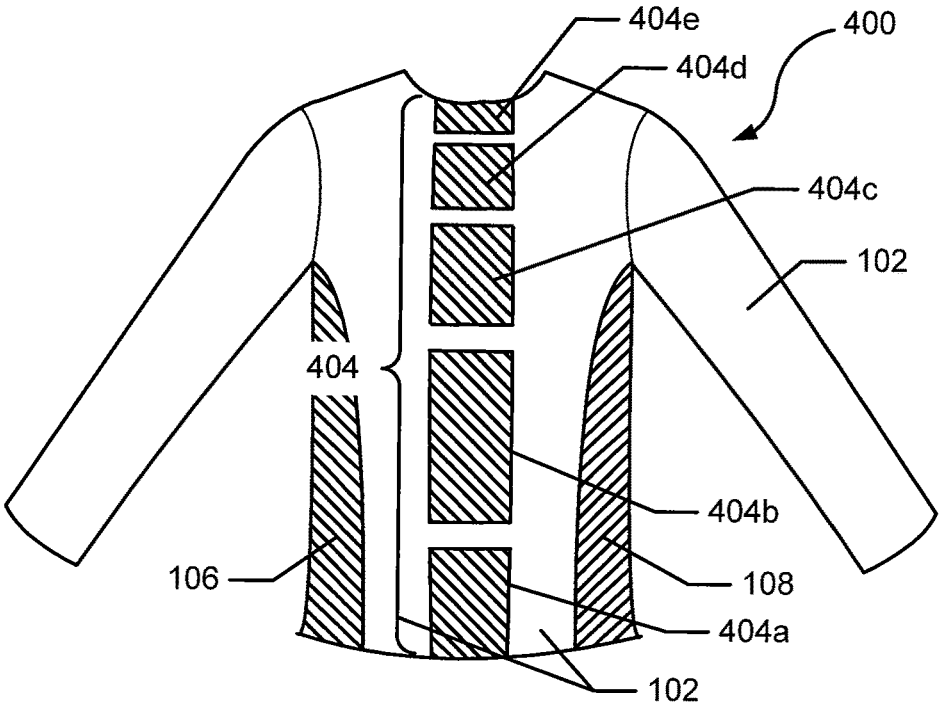
FIGS. 4A and 4B illustrate still another garment structure in accordance with an example of this invention.
Figure 4B:
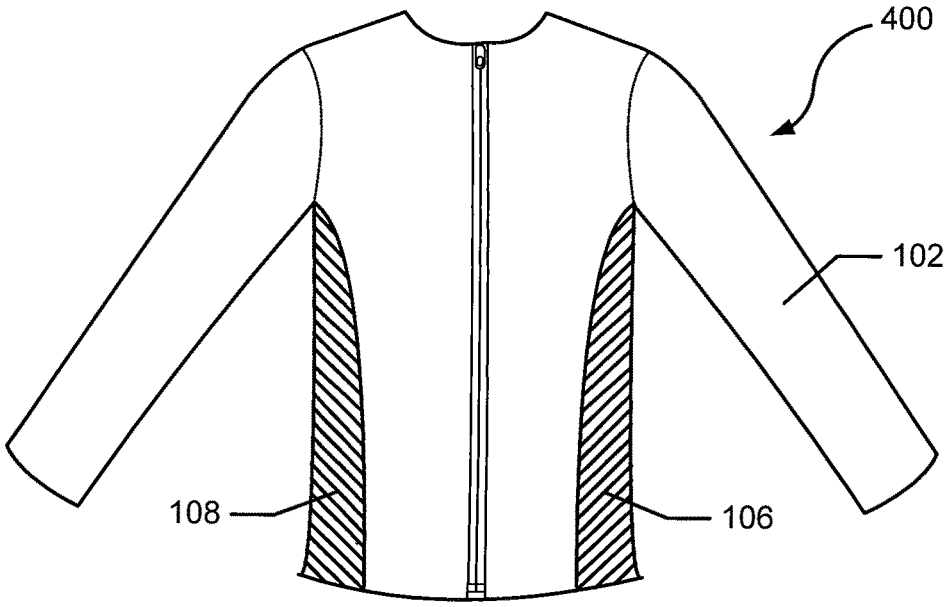

A wide variety of other variations in the sizes, structures, and/or arrangements of the various regions of a garment structure are possible without departing from this invention. For example, in the various garment structures 100, 200, and 300 described above, the high thermally insulative or thermally resistive regions were continuous. This is not a requirement. The example garment structure 400 shown in FIGS. 4A and 4B is similar to that shown in FIGS. 1A and 1B, but in this example garment structure 400, the central back region 404 is formed as a plurality of separate sub-regions 404*a*-404*e* that extend along the center back. The locations for the breaks in the central back region 404 may be selected in any desired manner without departing from this invention. For example, if desired, the breaks may be located at specific areas to provide additional overall flexibility (or to better decrease any binding feel) of the garment structure 400. As another example, if desired, the breaks may be located to produce an interesting aesthetic design, pattern, or logo. The breaks may extend in any desired direction, and any desired number of breaks may be included in the structure 400 without departing from this invention. Also, while not illustrated, breaks may be provided in the side regions 106 and/or 108 without departing from the invention.

The break areas also need not complete separate the sub-regions 404*a* through 404*e* from one another. Rather, if desired, one or more bridging areas may be provided to interconnect one or more of the sub-regions 404*a* through 404*e*. The bridging areas, when present, also may be made from the relatively high thermally insulative or thermally resistive materials.

Garments in accordance with examples of this invention may be produced in any desired manner without departing from this invention, including, at least in part, through the use of conventional production steps and/or convention production equipment as are known and used in the garment formation art. For example, if desired, one or more separate pieces of material may be provided for each of the various regions (e.g., regions 102-108), and the various pieces of material may be engaged with one another so as to locate the various regions in their desired positions as described above. Sewing, stitching, adherents, fusing techniques, or the like may be used to engage the various pieces of material together. Additionally, the closure system(s) and/or size adjusting system(s) (e.g., buttons, snaps, straps, buckles, hook-type fasteners, hook-and-loop type fasteners, draw string and/or tie type fasteners, elastic materials, etc.), if any, may be included in the garment structures in any desired manners without departing from this invention, including in manners that are conventionally known and used in the art. As additional examples, commercial garment knitting and/or weaving machines may be programmed to produce the desired garment structure including the desired regions of different thermal insulative or resistive properties (e.g., by selecting different yarns, stitching patterns, weaving patterns, texturing, or the like at the various locations of the desired regions).

Of course, a wide variety of variations in the fabrics, garments, and/or their production processes are possible without departing from this invention. For example, if desired, one or more of the various high thermally resistive regions may be omitted from a specific garment structure in accordance with at least some examples of this invention. Moreover, the various different steps in the production processes may be changed, changed in order, additional steps may be added, and/or the described steps may be eliminated and/or replaced with other steps or procedures without departing from this invention.

III. CONCLUSION

Aspects of this invention may be used in conjunction with systems and methods like those described in commonly owned and co-pending U.S. patent application Ser. No. 11/059,357, filed Feb. 17, 2005 in the name of Edward L. Harber and entitled "Articles of Apparel Utilizing Targeted Venting or Heat Retention Zones that may be Defined Based on Thermal Profiles" and U.S. patent application Ser. No. 11/424,991, filed Jun. 19, 2006 in the name of Edward L. Harber and entitled "Fabrics and Articles of Apparel Including Dimensionalized Mesh and Other Fabrics." These co-pending U.S. Patent Applications are entirely incorporated herein by reference.

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. An outerwear garment for covering at least a portion of an upper human torso, comprising:

a first garment region including a first thermal fabric material extending along a central back portion of the outerwear garment from proximate to a waist area of the outerwear garment to proximate to a neck area of the outerwear garment;

a second garment region including a second thermal fabric material extending along a first side of the outerwear garment from the waist area to a first underarm area of the outerwear garment;

a third garment region including a third thermal fabric material extending along a second side of the outerwear garment from the waist area to a second underarm area of the outerwear garment; and a fourth garment region located at: (a) a back of the outerwear garment between the first garment region and the second garment region, (b) the back of the outerwear garment between the first garment region and the third garment region, and (c) a front of the outerwear garment between the second garment region and the third garment region, wherein the fourth garment region makes up at least 50% of an overall exterior surface of the outerwear garment, wherein the fourth garment region includes one or more pieces of a first thermal material having a first thermal resistive value, wherein the first thermal fabric material, the second thermal fabric material, and the third thermal fabric material are provided as part of one or more pieces of fabric material, wherein each of the first thermal fabric material, the second thermal fabric material, and the third thermal fabric material has a thermal resistive value higher than the first thermal resistive value, wherein the first thermal resistive value is at least 10% lower than the thermal resistive values of each of the first thermal fabric material, the second thermal fabric material, and the third thermal fabric material, wherein the first thermal resistive value of the fourth garment region, the thermal resistive value of the first thermal fabric material, the thermal resistive value of the second thermal fabric material, and the thermal resistive value of the third thermal fabric material are measured according to International Organization for Standardization Test ISO 11092 under constant measuring parameter conditions, and wherein the outerwear garment constitutes a coat, a jacket, or a vest.

2. An outerwear garment for covering at least a portion of an upper human torso, comprising:

a first garment region including a first thermal fabric material extending along a central back portion of the outerwear garment from proximate to a waist area of the outerwear garment to proximate to a neck area of the outerwear garment;

a second garment region including a second thermal fabric material extending along a first side of the outerwear garment from the waist area to a first underarm area of the outerwear garment;

a third garment region including a third thermal fabric material extending along a second side of the outerwear garment from the waist area to a second underarm area of the outerwear garment; and a fourth garment region located at: (a) a back of the outerwear garment between the first garment region and the second garment region, (b) the back of the outerwear garment between the first garment region and the third garment region, and (c) a front of the outerwear garment between the second garment region and the third garment region, wherein the fourth garment region makes up at least 50% of an overall exterior surface of the outerwear garment, wherein the fourth garment region includes one or more pieces of a first thermal material having a first thermal resistive value, wherein the first thermal fabric material, the second thermal fabric material, and the third thermal fabric material are provided as part of one or more pieces of fabric material, wherein each of the first thermal fabric material, the second thermal fabric material, and the third thermal fabric material has a thermal resistive value higher than the first thermal resistive value, wherein the first thermal resistive value is at least 10% lower than the thermal resistive values of each of the first thermal fabric material, the second thermal fabric material, and the third thermal fabric material, wherein the first thermal resistive value of the fourth garment region, the thermal resistive value of the first thermal fabric material, the thermal resistive value of the second thermal fabric material, and the thermal resistive value of the third thermal fabric material are measured according to International Organization for Standardization Test ISO 11092 under constant measuring parameter conditions, and wherein the outerwear garment includes a waist opening defined therein, wherein the first garment region extends to the waist opening, wherein the second garment region extends to the waist opening, wherein the third garment region extends to the waist opening, wherein the fourth garment region extends: (a) to the waist opening between the first garment region and the second garment region, (b) to the waist opening between the first garment region and the third garment region, and (c) to the waist opening between the second garment region and the third garment region.

3. An outerwear garment according to claim 2, further comprising a neck opening size adjusting system located at a front neck opening of the outerwear garment, wherein the neck opening size adjusting system includes a zipper type size adjusting mechanism that extends from the front neck opening of the outerwear garment in a direction toward the waist opening of the outerwear garment, and wherein the zipper type closure system does not extend to the waist opening of the outerwear garment.

4. An outerwear garment for covering at least a portion of an upper human torso, comprising:

a first garment region including a first thermal fabric material extending along a central back portion of the outerwear garment from proximate to a waist area of the outerwear garment to proximate to a neck area of the outerwear garment;

a second garment region including a second thermal fabric material extending along a first side of the outerwear garment from the waist area to a first underarm area of the outerwear garment;

a third garment region including a third thermal fabric material extending along a second side of the outerwear garment from the waist area to a second underarm area of the outerwear garment; and a fourth garment region located at: (a) a back of the outerwear garment between the first garment region and the second garment region, (b) the back of the outerwear garment between the first garment region and the third garment region, and (c) a front of the outerwear garment between the second garment region and the third garment region, wherein the fourth garment region makes up at least 50% of an overall exterior surface of the outerwear garment, wherein the fourth garment region includes one or more pieces of a first thermal material having a first thermal resistive value, wherein the first thermal fabric material, the second thermal fabric material, and the third thermal fabric material are provided as part of one or more pieces of fabric material, wherein each of the first thermal fabric material, the second thermal fabric material, and the third thermal fabric material has a thermal resistive value higher than the first thermal resistive value, wherein the first thermal resistive value of the fourth garment region, the thermal resistive value of the first thermal fabric material, the thermal resistive value of the second thermal fabric material, and the thermal resistive value of the third thermal fabric material are measured according to International Organization for Standardization Test ISO 11092 under constant measuring parameter conditions, wherein the first thermal resistive value is at least 20% lower than each of: the thermal resistive value of the first thermal fabric material, (b) the thermal resistive value of the second thermal fabric material, and (c) the thermal resistive value of the third thermal fabric material, and wherein the outerwear garment is a coat or jacket, wherein each of the first thermal fabric material, the second thermal fabric material, and the third thermal fabric material is a polyester material, and wherein the thermal resistive value of each of the first thermal fabric material, the second thermal fabric material, and the third thermal fabric material is at least 0.21 $m^2 \times K/W$.

* * * * *